US010626891B2

(12) United States Patent
Nishikawa et al.

(10) Patent No.: US 10,626,891 B2
(45) Date of Patent: Apr. 21, 2020

(54) HYDRAULIC BLOCK

(71) Applicant: Kubota Corporation, Osaka-shi (JP)

(72) Inventors: Seimei Nishikawa, Sakai (JP); Juzo Okamoto, Sakai (JP); Yoshiro Takao, Sakai (JP); Sosuke Miyauchi, Sakai (JP); Eiji Miyazaki, Sakai (JP)

(73) Assignee: Kubota Corporation, Osaka (JP)

( * ) Notice: Subject to any disclaimer, the term of this patent is extended or adjusted under 35 U.S.C. 154(b) by 455 days.

(21) Appl. No.: 15/378,809

(22) Filed: Dec. 14, 2016

(65) Prior Publication Data

US 2017/0234336 A1 Aug. 17, 2017

(30) Foreign Application Priority Data

Feb. 16, 2016 (JP) ..... 2016-027265

(51) Int. Cl.
*F15B 13/08* (2006.01)
*F15B 13/02* (2006.01)
*F15B 13/04* (2006.01)

(52) U.S. Cl.
CPC ..... *F15B 13/022* (2013.01); *F15B 13/0817* (2013.01); *F15B 13/0402* (2013.01); *F15B 13/0814* (2013.01); *F15B 2211/30525* (2013.01); *F15B 2211/3116* (2013.01)

(58) Field of Classification Search
CPC ..... F15B 13/022; F15B 13/0817; F15B 13/0842; F15B 13/0832; F15B 13/0807; F15B 13/0871; F15B 2211/31594; F15B 2211/31547; F15B 2211/31517; F15B 2211/30–365; F15B 2211/30525; F15B 2211/3116; F15B 13/0402; F15B 13/0814; Y10T 137/87225; Y10T 137/87217; Y10T 137/87241; Y10T 137/87249
USPC ..... 137/596.17, 596.18, 596.2, 597; 60/420–494; 91/418–470
See application file for complete search history.

(56) References Cited

U.S. PATENT DOCUMENTS 2,285,968 A * 6/1942 Harrington ..... F15B 11/024 251/129.01
2,923,131 A * 2/1960 Furman ..... B41J 23/20 101/93.05
3,145,734 A * 8/1964 Lee ..... F15B 11/05 137/115.03
3,146,593 A * 9/1964 Stacey ..... E02F 3/32 60/421
3,156,098 A * 11/1964 La Rou ..... E02F 3/42 414/694

(Continued)

FOREIGN PATENT DOCUMENTS

JP 8105404 A 4/1996
JP 2015209908 A 11/2015

*Primary Examiner* — Craig J Price
(74) *Attorney, Agent, or Firm* — The Webb Law Firm

(57) ABSTRACT

A hydraulic block includes multiple pairs of actuator ports connectable to a hydraulic actuator and a discharge oil passage for discharging work oil returned from the hydraulic actuator to the outside. The charge oil passage includes a first oil passage corresponding to a predetermined actuator port of all the actuator ports and a second oil passage corresponding to non-predetermined actuator ports other than the predetermined actuator ports. The first oil passage is disposed in parallel with the second oil passage.

3 Claims, 4 Drawing Sheets

(56) References Cited

U.S. PATENT DOCUMENTS

| | | | | | |
|---|---|---|---|---|---|
| 3,258,926 | A * | 7/1966 | Junck | E02F 3/651 | 91/519 |
| 3,543,646 | A * | 12/1970 | Iijima | E02F 9/22 | 60/422 |
| 3,720,059 | A * | 3/1973 | Schurawski | B62D 11/183 | 60/421 |
| 3,722,543 | A * | 3/1973 | Tennis | F15B 13/08 | 137/271 |
| 3,759,292 | A * | 9/1973 | Bianchetta | E02F 9/2239 | 137/596 |
| 4,201,052 | A * | 5/1980 | Breeden | F15B 11/042 | 60/445 |
| 4,789,002 | A * | 12/1988 | Williams | F15B 13/08 | 137/596 |
| 4,955,461 | A * | 9/1990 | Keir | B66F 9/22 | 187/234 |
| 5,083,428 | A * | 1/1992 | Kubomoto | E02F 9/2239 | 60/421 |
| 5,586,577 | A * | 12/1996 | Cho | F15B 13/08 | 137/596.13 |
| 7,243,493 | B2 * | 7/2007 | Ma | F15B 11/006 | 137/625.25 |
| 7,415,822 | B1 * | 8/2008 | Harber | E02F 9/2232 | 60/413 |
| 7,415,989 | B2 * | 8/2008 | Barber | F15B 13/0402 | 137/596.12 |
| 8,316,757 | B2 * | 11/2012 | Rinaldi | F15B 13/01 | 137/625.64 |
| 9,091,281 | B2 * | 7/2015 | Quinnell | E02F 9/2235 | |
| 9,932,994 | B2 * | 4/2018 | Hashimoto | F15B 13/0402 | |
| 2016/0363140 | A1 | 12/2016 | Mizukami et al. | | |

* cited by examiner

HYDRAULIC BLOCK

CROSS-REFERENCE TO RELATED APPLICATION

This application claims priority to Japanese Patent Application No. 2016-027265 filed Feb. 16, 2016, the disclosure of which is hereby incorporated in its entirety by reference.

BACKGROUND OF THE INVENTION

Field of the Invention

The present invention relates to a hydraulic block having multiple pairs of actuator ports connected to a hydraulic actuator and a discharge oil passage for discharging work oil returned from the hydraulic actuator to the outside.

Background Art

Patent Document 1 (Japanese Unexamined Patent Application Publication No. 2015-209908) discloses a hydraulic block (referred to as "a valve body" in the document) having a pair of actuator ports connected to a hydraulic actuator (referred to as "a cylinder" in the document) and a discharge oil passage (referred to as "a return passage" in the document) for discharging work oil returned from the hydraulic actuator to the outside.

SUMMARY

Problem to be Solved by Invention

In the case of the hydraulic block disclosed in Patent Document 1, if multiple sets of the pair of actuator ports are provided, when oil passages corresponding to the actuator ports are connected in series to constitute the discharge oil passage, this discharge oil passage will have an undesirably long length. In this case, within the discharge oil passage, an oil pressure difference (pressure loss) is large between the discharging direction upstream side and the discharging direction downstream side, which tends to invite a malfunction.

In view of the above-described state of the art, there is a need for a hydraulic block capable of reducing pressure loss due to the length of the discharge oil passage.

Solution

According to the present invention, a hydraulic block comprises:

multiple pairs of actuator ports connectable to a hydraulic actuator; and a discharge oil passage for discharging work oil returned from the hydraulic actuator to the outside, the discharge oil passage including a first oil passage corresponding to a predetermined actuator port of all the actuator ports and a second oil passage corresponding to non-predetermined actuator ports other than the predetermined actuator ports;

wherein the first oil passage is disposed in parallel with the second oil passage.

With the above characterizing feature, since the first oil passage is disposed in parallel with the second oil passage, the length of the discharge oil passage is shorter than the case of constituting the discharge oil passage by connecting the oil passages corresponding to the actuators in series. Thus, it is possible to reduce the pressure loss due to the length of the discharge oil passage. Moreover, since the discharge oil passage has a parallel construction, the pressure difference inside the discharge oil passage is reduced also.

Further, in the present invention, preferably:

a hydraulic valve is provided between the predetermined actuator port and the first oil passage.

With the above characterizing feature, it is possible to reduce pressure loss on the discharge direction downstream side relative to the hydraulic valve. Thus, the hydraulic valve can be operated in a favorable manner without causing malfunction in the hydraulic valve.

Further, in the present invention, preferably:

the hydraulic block comprises a single block body.

Here, in case multiple pairs of actuator ports are to be provided, for instance, it is possible to constitute the hydraulic block of a plurality of block bodies. In such case, however, as the plurality of block bodies need to be connected to each other, assembly of the hydraulic block is not easy. With the above characterizing feature, since the hydraulic block is constituted of a single block body, there is no need to connect a plurality of block bodies and the hydraulic block can be assembled easily.

Further, in the present invention, preferably:

the first oil passage is connected in parallel with the second oil passage via a third oil passage.

With the above characterizing feature, the discharge oil passage having a parallel construction can be formed easily, simply by connecting the first oil passage and the second oil passage via the third oil passage.

Further, in the present invention, preferably:

the second oil passage includes a first portion, a second portion, a third portion, a fourth portion and a fifth portion, the second oil passage having an approximately C-shape as viewed in a front view of the hydraulic block;

the first portion is disposed at one end of the second oil passage;

the second portion is disposed at the other end of the second oil passage;

the third portion, the fourth portion and the fifth portion are disposed between the first portion and the second portion, in an order of the fourth portion, the third portion and the fifth portion from the first portion side;

the first portion and the second portion correspond to the non-predetermined actuator ports relative to one actuator port of the respective pair of actuator ports; and the third portion corresponds to the non-predetermined actuator port relative to the other actuator port of the respective pair of actuator ports.

Further, in the present invention, preferably:

the first oil passage is connected in parallel with the second oil passage via a third oil passage; and the third oil passage extends between the first oil passage and the third portion of the second oil passage.

Further, in the present invention, preferably:

the discharge oil passage includes a fourth oil passage that extends between the third portion of the second oil passage and the outside; and an end on the outer side of the fourth oil passage is connected to an external tank.

Further, in the present invention, preferably:

for each pair of the actuator ports, there are provided a direction switch valve for switching an oil feeding direction of work oil to the pair of actuator ports and a spool bore in which a spool of the direction switch valve is slidably inserted;

the first oil passage and the third oil passage are connected in form of approximately T-shape as seen in the front view of the hydraulic block; and the first oil passage extends between one spool bore and the other spool bore of a pair of the spool bores adjacent each other.

Further, in the present invention, preferably:

there is provided a direction switch valve for switching feeding direction of work oil to the pair of actuator ports;

a hydraulic valve is disposed on an oil feeding passage to the direction switch valve; and the hydraulic valve is disposed at a position offset in a vertical direction and a left-right direction relative to the pair of actuator ports as seen in the front view of the hydraulic block.

Further, in the present invention, preferably:

a tank port connected to an external tank is provided in a side of a block body constituting the hydraulic block.

Further, in the present invention, preferably:

for each pair of the actuator ports, there are provided a direction switch valve for switching an oil feeding direction of work oil to the pair of actuator ports and a spool bore in which a spool of the direction switch valve is slidably inserted; and as seen in the front view of the hydraulic block, the spool bores are disposed with approximately equal spaces therebetween, the tank port being disposed at a position overlapped with the spool bores adjacent each other.

Further, in the present invention, preferably:

there are provided a feeding oil passage for feeding work oil to the plurality of pairs of actuator ports and a hydraulic pump for pressure-feeding the work oil to the feeding oil passage; and a pump port to which the hydraulic pump is connected is provided in a side of a block body constituting the hydraulic block.

Further, in the present invention, preferably:

there is provided a direction switch valve for switching feeding direction of work oil to the pair of actuator ports including the predetermined actuator port; and the hydraulic valve is disposed immediately above the direction switch valve as seen in a section view of the hydraulic block.

EMBODIMENT

Next, an embodiment of the present invention will be explained with reference to the accompanying drawings.

[Hydraulic Block]

Figure 1:
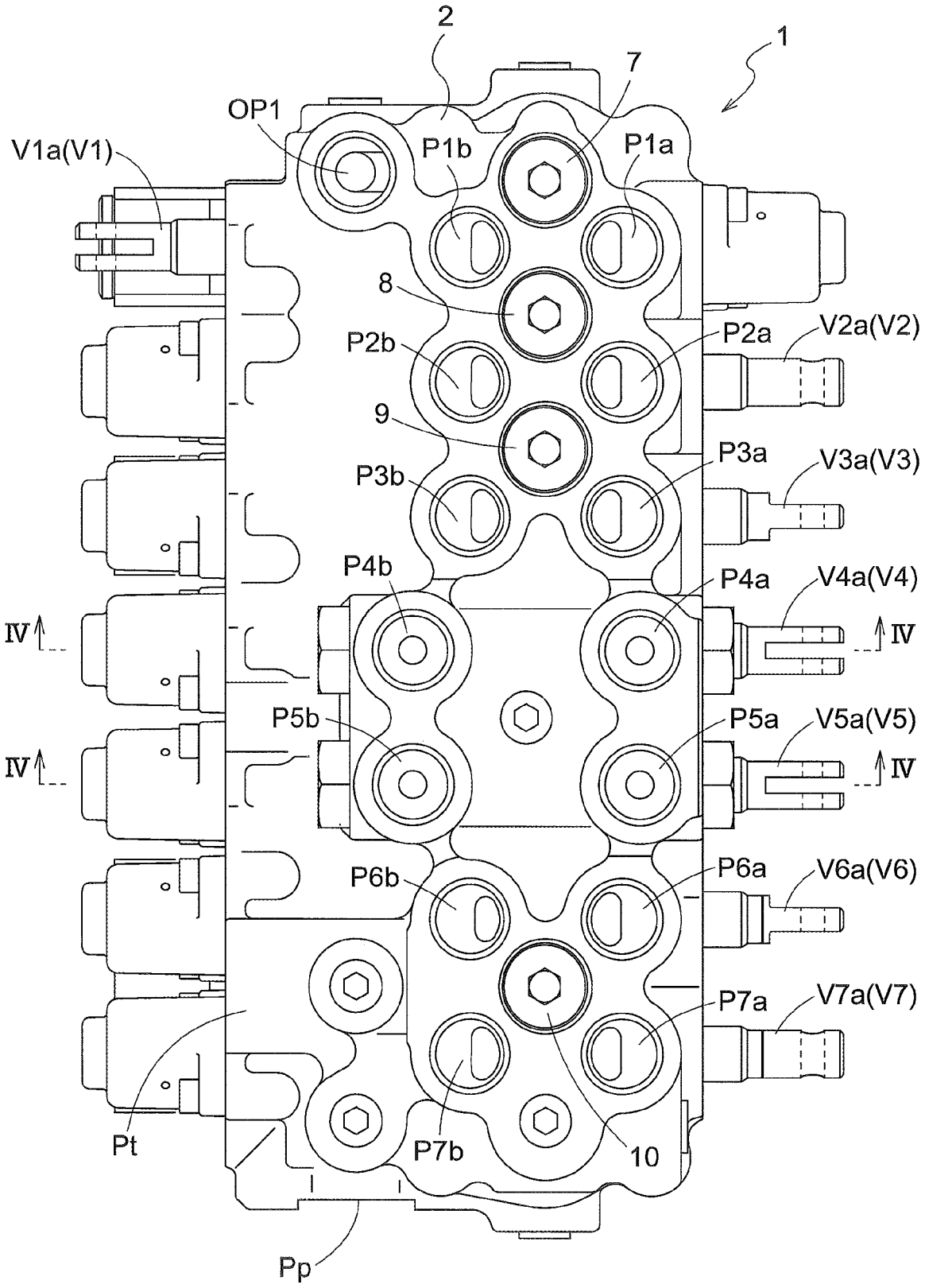
FIG. 1 is a front view of a hydraulic block.
Figure 2:
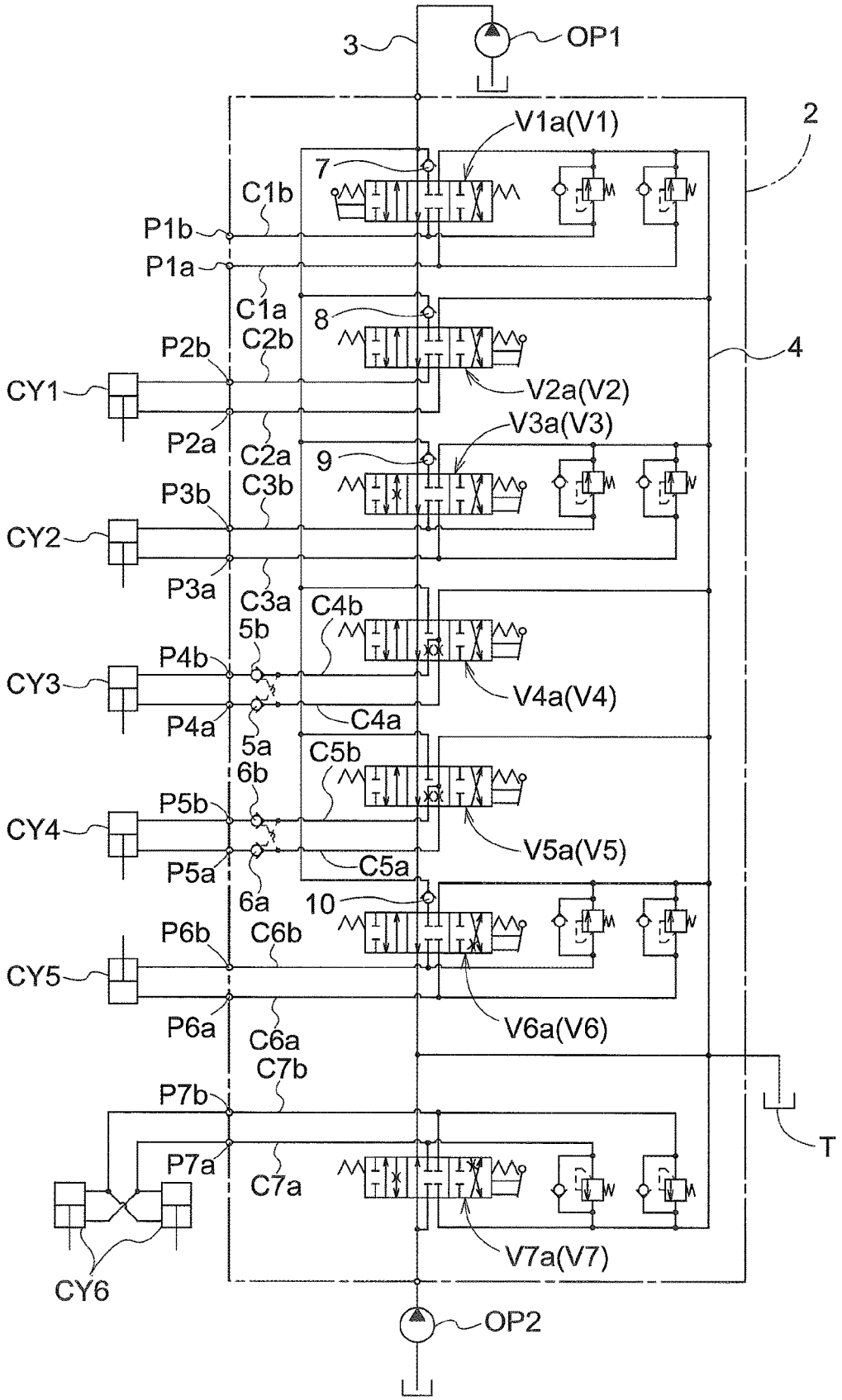
FIG. 2 is a hydraulic circuit diagram of the hydraulic block.

As shown in FIG. 1 and FIG. 2, a hydraulic block 1 includes multiple sets (e.g. seven sets) of pairs of first through seventh actuator ports P1*a*•P1*b* through P7*a*•P7*b*, respectively. The hydraulic block 1 comprises a single block body 2 (e.g. made of cast material). In this embodiment, the hydraulic block 1 is used as a hydraulic block for a backhoe (not shown) to be mounted to a rear portion of a tractor (not shown). This backhoe includes, as "hydraulic actuators" relating to the invention, a bucket hydraulic cylinder CY1, a clipper hydraulic cylinder CY2, a right stabilizer hydraulic cylinder CY3, a left stabilizer hydraulic cylinder CY4, a boom hydraulic cylinder CY5 and a swing hydraulic cylinder CY6.

Here, corresponding relations between the first through seventh actuator ports P1*a*•P1*b* through P7*a*•P7*b* and the hydraulic cylinders CY1 through CY6 will be explained. To one pair of second actuator ports P2*a*•P2*b*, the bucket hydraulic cylinder CY1 is connected. To one pair of third actuator ports P3*a* P3*b*, the dipper hydraulic cylinder CY2 is connected.

To one pair of fourth actuator ports P4*a*•P4*b*, the right stabilizer hydraulic cylinder CY3 is connected. One fourth actuator port P4*a* corresponds to what is referred to as "a predetermined actuator port" in the present invention.

To one pair of fifth actuator ports P5*a*•P5*b*, the left stabilizer hydraulic cylinder CY4 is connected. One fifth actuator port P5*a* corresponds to what is referred to as "a predetermined actuator port" in the present invention.

To one pair of sixth actuator ports P6*a*•P6*b*, the boom hydraulic cylinder CY5 is connected. To one pair of seventh actuator ports P7*a*•P7*b*, the swing hydraulic cylinder CY6 is connected.

One pair respectively of the first through third actuator ports P1*a*•P1*b* through P3*a*•P3*b*, the other fourth and fifth actuator ports P4*b*, P5*b*, and one pair respective of the sixth and seventh actuator ports P6*a*•P6*b*, P7*a*•P7*b* correspond to "the non-predetermined actuator ports" relating to the present invention.

Incidentally, in the instant embodiment, no "hydraulic actuators" relating to the present invention are connected to the one pair of first actuator ports P1*a*•P1*b*. In case a hydraulic cylinder separately from the hydraulic cylinders CY1 through CY6 is provided as "a hydraulic actuator" relating to the present invention, such further hydraulic actuator can be connected to the one pair of first actuator ports P1*a*•P1*b*.

The hydraulic block 1 includes first through seventh direction switch valves V1 through V7. These first through seventh direction switch valves V1 through V7 respectively switch oil feeding direction of the work oil to the one pair of the first through seventh actuator ports P1*a*•P1*b* through P7*a*•P7*b*, respectively.

Figure 3:
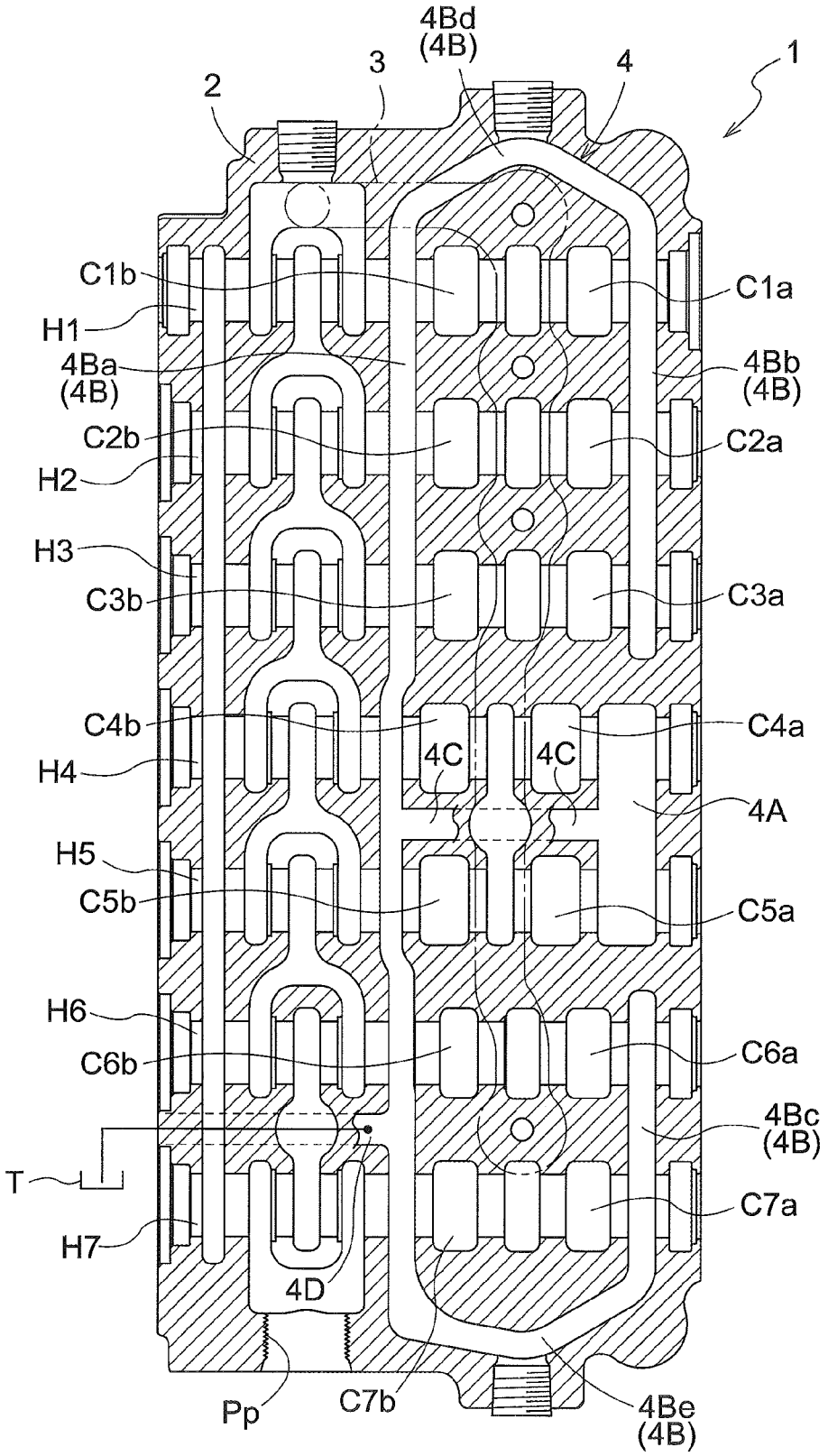
FIG. 3 is a front view in section of the hydraulic block.

As shown in FIG. 2 and FIG. 3, inside the block body 2, there are formed first through seventh spool bores H1 through H7, a feeding oil passage 3, one pair of first through seventh connecting oil passages C1*a*•C1*b* through C7*a*•C7*b*, and a discharge oil passage 4. In the first through seventh spool bores H1 through H7, first through seventh spools V1*a* through V7*a* of the first through seventh direction switch valves V1 through V7 are slidably inserted respectively. To the feeding oil passage 3, work oil pressure-fed by a first hydraulic pump OP1 and a second hydraulic pump OP2 is fed. A pump port Pp to which the second hydraulic pump OP2 is connected is provided in a side (a lower side) of the block body 2.

The one pair of first connecting oil passages C1*a*•C1*b* extend between the one pair of first actuator ports P1*a*•P1*b* and the first spool bore H1. The one pair of second connecting oil passages C2*a*•C2*b* extend between the one pair of second actuator ports P2*a*•P2*b* and the second spool bore H2. The one pair of third connecting oil passages C3*a*•C3*b* extend between the one pair of third actuator ports P3*a*•P3*b* and the third spool bore H3.

The one pair of fourth connecting oil passages C4*a*•C4*b* extend between the one pair of fourth actuator ports P4*a*•P4*b* and the fourth spool bore H4. The one pair of fourth connecting oil passages C4*a*•C4*b* respectively incorporate check valves 5*a* 5*b*. The check valve 5*a* corresponds to what is referred to as "a hydraulic valve" (a hydraulic valve provided between the predetermined actuator port and the first oil passage) in the present invention.

The one pair of fifth connecting oil passages C5*a*•C5*b* extend between the one pair of fifth actuator ports P5*a*•P5*b* and the fifth spool bore H5. The one pair of fifth connecting oil passages C5*a*•C5*b* respectively incorporate check valves 6*a* 6*b*. The check valve 6*a* corresponds to what is referred to as "a hydraulic valve" (a hydraulic valve provided between the predetermined actuator port and the first oil passage) in the present invention.

The one pair of sixth connecting oil passages C6*a*•C6*b* extend between the one pair of sixth actuator ports P6*a*•P6*b* and the sixth spool bore H6. The one pair of seventh connecting oil passages C7*a*•C7*b* extend between the one pair of seventh actuator ports P7*a*•P7*b* and the seventh spool bore H7.

On the oil feeding passage to the first direction switch valve V1, a check valve 7 is provided. On the oil feeding passage to the second direction switch valve V2, a check valve 8 is provided. On the oil feeding passage to the third direction switch valve V3, a check valve 9 is provided. On the oil feeding passage to the sixth direction switch valve V6, a check valve 10 is provided. These check valves 7, 8, 9 and 10 correspond to "hydraulic valves" (hydraulic valve provided in oil feeding passage to direction switch valve) relating to the present invention.

Figure 4:
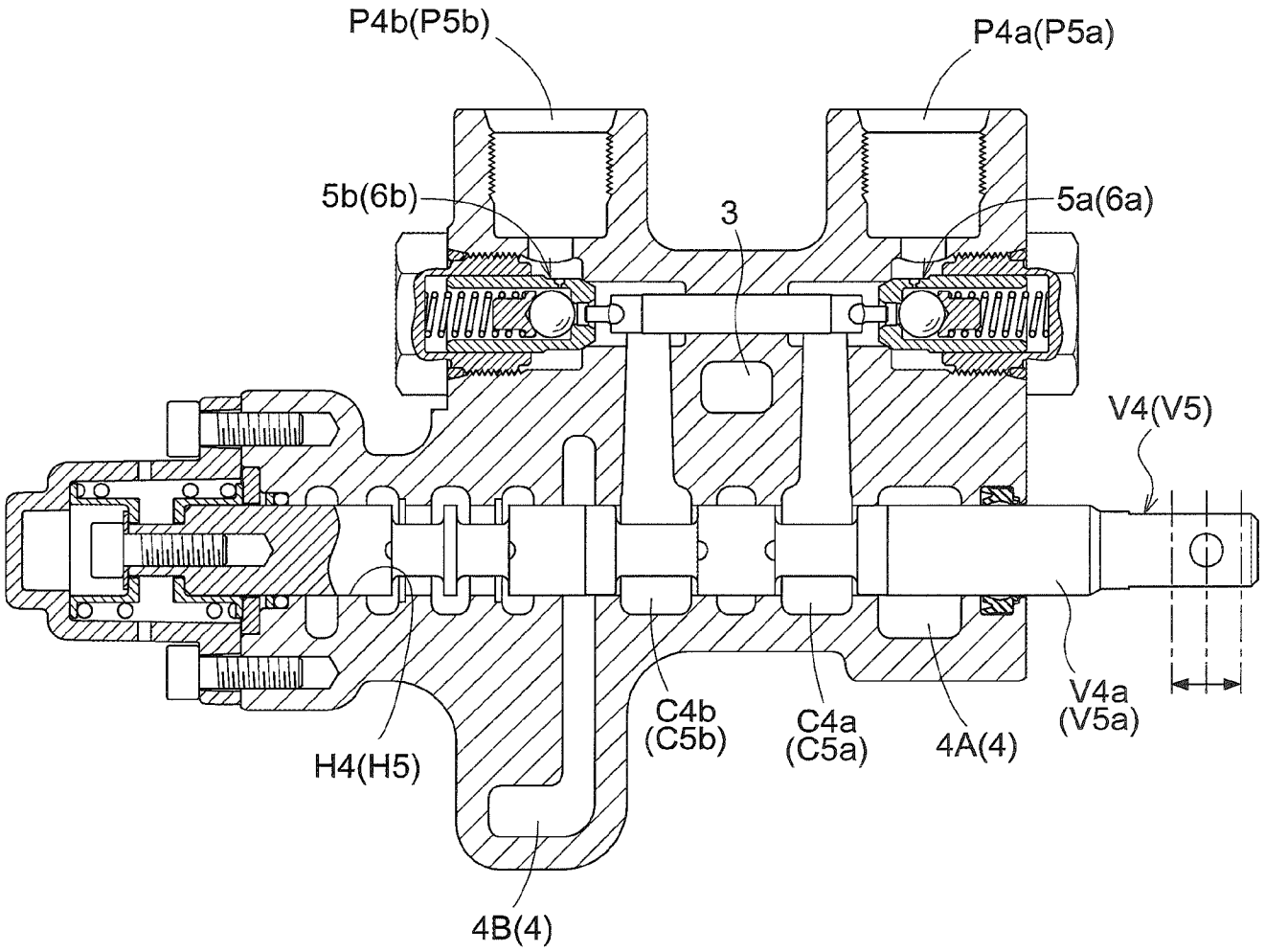
FIG. 4 is a section taken along Iv-Iv in FIG. 1.

Here, it is noted that of the hydraulic block 1, its cross sectional face corresponding to the fourth spool bore H4 and its cross sectional face corresponding to the fifth spool bore H5 have identical cross sectional arrangement and these cross sectional faces (section IV-IV in FIG. 1) are illustrated in FIG. 4. As shown in FIG. 4, the check valve 5*a* (6*a*) is provided between the one fourth actuator port P4*a* (the one fifth actuator port P5*a*) and the first oil passage 4A of the discharge oil passage 4. The check valve 5*b* (6*b*) is provided between the other fourth actuator port P4*b* (the other fifth actuator port P5*b*) and the second oil passage 4B of the discharge oil passage 4.

[Discharge Oil Passage]

As shown in FIG. 3, the discharge oil passage 4 discharges work oil returned from the one pair of the first through seventh actuator ports P1*a*•P1*b* through P7*a*•P7*b* to a tank T. The tank port Pt connected to the external tank T is provided in a side (a lateral side) of the block body 2. As seen in a front view, the first through seventh spool bores H1 through H7 are disposed with approximately equal spaces therebetween, and the tank port Pt is disposed at a position overlapped with the sixth spool bore H6 and the seventh spool bore H7 adjacent each other. The discharge oil passage 4 includes the first oil passage 4A, the second oil passage 4B, a third oil passage 4C and a fourth oil passage 4D.

The first oil passage 4A corresponds to the one fourth and fifth actuator ports P4*a*, P5*a*. Namely, as will be detailed later, into this first oil passage 4A, work oil from the one fourth and fifth actuator ports P4*a*, P5*a* flows. The first oil passage 4A is connected in parallel with the second oil passage 4B via the third oil passage 4C. That is, the first oil passage 4A is branched from the second oil passage 4B via the third oil passage 4C. Opposed longitudinal end portions of the first oil passage 4A are discommunicated from the second oil passage 4B. In other words, the opposed longitudinal end portions of the first oil passage 4A are not connected to the second oil passage 4B. The first oil passage 4A has an oil passage width which is wider than oil passage width of the second oil passage 4B and the third oil passage 4C as well as the oil passage width of the fourth oil passage 4D, as seen in its front view.

The second oil passage 4B corresponds to the one pair of first through third actuator ports P1*a*•P1*b* through P3*a*•P3*b*, the other fourth and fifth actuator ports P4*b*, P5*b* and the one pair of sixth and seventh actuator ports P6*a*•P6*b*, P7*a*•P7*b*. Namely, as will be detailed later, into this second oil passage 4B, work oil from the one pair of first through third actuator ports P1*a*•P1*b* through P3*a*•P3*b*, work oil from the other fourth and fifth actuator ports P4*b*, P5*b* and work oil from the one pair of sixth and seventh actuator ports P6*a*•P6*b*, P7*a*•P7*b* flow. The second oil passage 4B includes a portion 4Ba (corresponding to "a third portion" in the present invention), a portion 4Bb (corresponding to "a first portion" in the present invention), a portion 4Bc (corresponding to "a second portion" in the present invention), a portion 4Bd (corresponding to "a fourth portion" in the present invention) and a portion 4Be (corresponding to "a fifth portion" in the present invention).

The portion 4Ba corresponds to the other first through seventh actuator ports P1*b* through P7*b*. The portion 4Bb corresponds to the one first through third actuator ports P1*a* through P3*a*. The portion 4Bc corresponds to the one sixth and seventh actuator ports P6*a*, P7*a*. The portion 4Bd extends between the portion 4Ba and the portion 4Bb. The portion 4Be extends between the portion 4Ba and the portion 4Bc.

The third oil passage 4C extends between the first oil passage 4A and the portion 4Ba of the second oil passage 4B. The third oil passage 4C is located between the fourth spool bore H4 and the fifth spool bore H5 as seen in its front view. The first oil passage 4A side end portion of the third oil passage 4C is connected to the longitudinal center portion of the first oil passage 4A.

The fourth oil passage 4D extends between the portion 4Ba of the second oil passage 4*b* and the outside. The outside end portion of the fourth oil passage 4D is connected to the tank T. The fourth oil passage 4D is located between the sixth spool bore H6 and the seventh spool bore H7 as seen in its front view.

[Flow of Work Oil to Discharge Oil Passage]

Next, flow of work oil to the discharge oil passage 4 will be explained with reference to FIG. 3. Into the first oil passage 4A, work oil from the one fourth and fifth actuator ports P4*a*, P5*a* flows. More particularly, into the first oil passage 4A, the work oil from the one fourth actuator port P4*a* flows via the one fourth connecting oil passage C4*a* and work oil from the one fifth actuator port P5*a* flows via the one fifth connecting oil passage C5*a*. And, the work oil present inside the first oil passage 4A flows into the second oil passage 4B via the third oil passage 4C.

Further, into the second oil passage 4B, work oil from the one pair of first through third actuator ports P1*a*•P1*b* through P3*a*•P3*b*, work oil from the other fourth and fifth actuator ports P4*b*, P5*b*, and work oil from the one pair of the sixth and seventh actuator ports P6*a*•P6*b*, P7*a*•P7*b* flow. More particularly, into the portion 4Ba, the work oil from the other first through seventh actuator ports P1*b* through P7*b* flows via the other first through seventh connecting oil passages C1*b* through C7*b*, respectively. Into the portion 4Bb, the work oil from the one first through third actuator ports P1*a* through P3*a* flows via the one first through third connecting oil passages C1*a* through C3*a*, respectively. Into the portion 4Bc, the work oil from the one sixth and seventh actuator ports P6*a*, P7*a* flows via the one sixth and seventh connecting oil passages C6*a*, C7*a*, respectively. And, eventually, the work oil present inside the second oil passage 4B is discharged via the fourth oil passage 4D to the tank T.

Here, the flow of work oil in the cross sectional face of the hydraulic block 1 corresponding to the fourth spool bore H4 will be explained with reference to FIG. 4. Incidentally, as described above, the cross sectional face of the hydraulic block 1 corresponding to the fourth spool bore H4 and the cross sectional face of the hydraulic block 1 corresponding to the fifth spool bore H5 are identical. So, the flow of work oil in the cross sectional face corresponding to the fifth spool bore H5 in the hydraulic block 1 can be understood similarly to the flow of work oil in the cross sectional face corresponding to the fourth spool bore H4 in the hydraulic block 1.

In FIG. 4, the fourth spool V4*a* is located at its neutral position. Firstly, when the fourth spool V4*a* slides from the neutral position to the right side in the plane of illustration of FIG. 4, the one fourth connecting oil passage C4*a* and the first oil passage 4A are communicated with each other via the fourth spool bore H4, and also the other fourth connecting oil passage C4*b* and the feeding oil passage 3 are communicated with each other via the fourth spool bore H4. With this, work oil from the one fourth actuator port P4*a* flows into the first oil passage 4A via the one fourth connecting oil passage C4*a* and the fourth spool bore H4 and also work oil from the feeding oil passage 3 flows into the other fourth actuator port P4*b* via the fourth spool bore H4 and the other fourth connecting oil passage C4*b*.

On the other hand, when the fourth spool V4*a* slides from the neutral position to the left side in the plane of illustration of FIG. 4, the one fourth connecting oil passage C4*a* and the feeding oil passage 3 are communicated with each other via the fourth spool bore H4, and also the other fourth connecting oil passage C4*b* and the second oil passage 4B are communicated with each other via the fourth spool bore H4. With this, work oil from the feeding oil passage 3 flows into the one fourth actuator port P4*a* via the fourth spool bore H4 and the one fourth connecting oil passage C4*a*, and also work oil from the other fourth actuator port P4*b* flows into the second oil passage 4B via the other fourth connecting oil passage C4*b* and the fourth spool bore H4.

Incidentally, when the fourth spool V4*a* is located at the neutral position, due to a small gap formed between the fourth spool V4*a* and the fourth spool bore H4, the one fourth connecting oil passage C4*a* and the first oil passage 4A are communicated with each other also, and the other fourth connecting oil passage Cb4 and the second oil passage 4B are communicated with each other also.

With the above-described configuration, since the first oil passage 4A is disposed in parallel with the second oil passage 4B, the length of the discharge oil passage 4 is shorter than the case of constituting the discharge oil passage 4 by connecting the oil passages corresponding to the hydraulic cylinders CY1 through CY6 in series. Thus, it is possible to reduce the pressure loss due to the length of the discharge oil passage 4. Further, thanks to the parallel construction of the discharge oil passage 4, the pressure difference present inside the discharge oil passage 4 can be made smaller.

OTHER EMBODIMENTS (1) In the foregoing embodiment, the "predetermined actuator port" relating to the present invention comprises the one fourth and fifth actuator ports P4*a*, P5*a*. But, they are not limited to these.

(2) In the foregoing embodiment, the "hydraulic actuator" relating to the present invention comprises the hydraulic cylinders CY1 through CY6. But, they are not limited to these. The "hydraulic actuator" relating to the present invention can comprise hydraulic motors, for instance.

(3) In the foregoing embodiment, the "one pair of actuator ports" relating to the present invention are provided by seven sets. But, they are not limited to seven sets, but can be any plurality of sets.

(4) In the foregoing embodiment, the "hydraulic valve" relating to the present invention comprises the check valves 5*a*, 6*a*. But, they are not limited to these. The "hydraulic valve" relating to the present invention can be a relief valve, for instance.

(5) In the foregoing embodiment, the hydraulic block 1 comprises a single block body 2. But, it can be constituted of a plurality of block bodies.

(6) The present invention is applicable not only to a hydraulic block for a tractor, but also to a hydraulic block for a rice planting machine, a combine, etc.

The invention claimed is:

1. A hydraulic block comprising:

multiple pairs of actuator ports, each pair of actuator ports being connectable to one of a plurality of a hydraulic actuator; and a discharge oil passage for discharging work oil returned from the hydraulic actuator to the outside, the discharge oil passage including a first oil passage corresponding to a predetermined actuator port of all the actuator ports and a second oil passage corresponding to non-predetermined actuator ports other than the predetermined actuator ports;

wherein:

the first oil passage is disposed in parallel with the second oil passage;

the second oil passage includes a first portion, a second portion, a third portion, a fourth portion and a fifth portion, the second oil passage having an approximately C-shape as viewed in a front view of the hydraulic block;

the first portion is disposed at one end of the second oil passage;

the second portion is disposed at the other end of the second oil passage;

the third portion, the fourth portion and the fifth portion are disposed between the first portion and the second portion, in an order from the first portion to the second portion, of the fourth portion, the third portion and the fifth portion;

the first portion and the second portion correspond to the non-predetermined actuator ports relative to one actuator port of a respective pair of actuator ports; and the third portion corresponds to the non-predetermined actuator port relative to the other actuator port of the respective pair of actuator ports.

2. The hydraulic block according to claim 1, wherein:

the first oil passage is connected in parallel with the second oil passage via a third oil passage; and the third oil passage extends between the first oil passage and the third portion of the second oil passage.

3. The hydraulic block according to claim 1, wherein:

the discharge oil passage includes a fourth oil passage that extends between the third portion of the second oil passage and the outside; and an end on the outer side of the fourth oil passage is connected to an external tank.

* * * * *